US005507046A

United States Patent [19]

Taylor

[11] Patent Number: 5,507,046

[45] Date of Patent: Apr. 16, 1996

[54] BED AND CANOPY

[76] Inventor: Sylvia W. Taylor, 1500 Cedar Bluff Trail, Marietta, Ga. 30062

[21] Appl. No.: 386,283

[22] Filed: Feb. 9, 1995

Related U.S. Application Data

[63] Continuation-in-part of Ser. No. 83,930, Jun. 29, 1993, abandoned.

[51] Int. Cl.[6] ..... A47C 29/00

[52] U.S. Cl. ..... 5/414; 5/658

[58] Field of Search ..... 5/414, 413, 416, 5/85.1, 512, 658

[56] References Cited

U.S. PATENT DOCUMENTS

| | | | |
|---|---|---|---|
| 785,571 | 3/1905 | Raines | 5/414 |
| 875,206 | 12/1907 | Osborne | 5/414 |
| 1,227,301 | 5/1917 | Ogden | 5/85.1 |
| 2,539,566 | 1/1951 | Bedard | 5/85.1 |
| 4,958,391 | 9/1990 | Egeland | 5/414 |

FOREIGN PATENT DOCUMENTS

| | | | |
|---|---|---|---|
| 2569547 | 3/1986 | France | 5/414 |

*Primary Examiner*—Flemming Saether
*Attorney, Agent, or Firm*—Hopkins & Thomas

[57] ABSTRACT

A portable free standing canopy frame and bed is provided for decorating and interior design in a bedroom. The canopy includes a lower assembly which rests directly on the floor and is free standing, completely independent of any support from the bed. Vertical tubular sections (A) are joined with upper Tee and elbow joints (B) to support the canopy top (G). The upper canopy top assembly provides a rectangular structure of a width and length greater than width and length of the bed so as to provide a support for fabric which overhangs the sides of the bed below.

2 Claims, 2 Drawing Sheets

BED AND CANOPY

CROSS REFERENCE TO RELATED APPLICATION

This application is a continuation in part of my U.S. patent application 8/083,930, filed Jun. 29, 1993 now abandoned.

FIELD OF THE INVENTION

The present invention relates in general to a bed canopy, and in particular a free standing portable canopy mounted about a bed, for decorating and interior design.

BACKGROUND OF THE INVENTION

Various canopies have been proposed in the prior art for beds, other sleeping compartments and shelters of varying types.

U.S. Pat. No. 493,305 issued to Sherman is directed to an adjustable ventilating canopy frame for beds. The main purpose of the canopy is to provide a simple frame embodying in its construction an adjustable ventilating fan. Hence, this canopy is designed for the comfort of the person sleeping in the bed. The Sherman canopy is characterized by having its upright members secured to the bed frame itself.

U.S. Pat. No. 326,437 issued to Marsh is directed to a bed screen frame which is attached interiorly within the perimeter of the bed. The purpose of the Marsh adjustable frame is for supporting screens of mosquito netting and the like.

U.S. Pat. No. 2,690,186 issued to Ball is directed to a canopy support for cots. It will be observed that the Ball supporting structure is designed for supporting a mosquito netting or tent over a camper's cot and is attached to the upper portion of the cot structure itself.

U.S. Pat. No. 3,741,225 discloses a canopy which is a single attachment unit to be mounted onto the extended bed post.

U.S. Pat. No. 4,770,294 issued to Miller is directed to a steel tubular protective structure capable of deflecting and/or resisting impact from falling objects and retaining same and comprising a lower assembly and upper assembly.

U.S. Pat. No. 4,958,391 issued to Egeland relates to bed frames. Egeland supports a bed with the canopy structure, with the bed supported by ropes, etc. which allow the bed or mattress to sway or swing within the canopy frame.

French Patent 2569-547 discloses a kit frame and panels to surround a bed and keep its occupants warm while allowing part of a large room to be heated.

SUMMARY OF THE INVENTION

The present invention is structured so as to provide a decorating device for interior design of a home, etc. A separate unit, free standing to accommodate all sizes of bedding, day bed, twin, full, queen and king size beds, can be fitted within the structure. An object of the invention is to provide such a device of simple, inexpensive construction, which can be constructed with various types and sizes of materials, such as plastic PVC pipe, copper, steel, wood, brass and aluminum. The invention will allow for quick and easy assembly and disassembly, and for convenient transportation. A unique characteristic of the invention is the intermediate support at the base of the structure, which inserts in a tee joint at the head and in another tee joint at the foot. Tubular sections connect to the tee joints, according to the width of the bed size, to support the vertical tubular sections at the corners of the structure. This intermediate support allows easy access to opposite sides of the bed without any interference to one's feet. The vertical tubular sections will have tee joints and elbow joints on top to connect to tubular sections the width and length of the bed, which will form a canopy around the top perimeter. A small piece of the tubular pipe will be inserted between the elbow and tee joints for the two like pieces to fit securely together, completing the canopy structure.

DETAILED DESCRIPTION OF THE DRAWINGS

Figure 1:
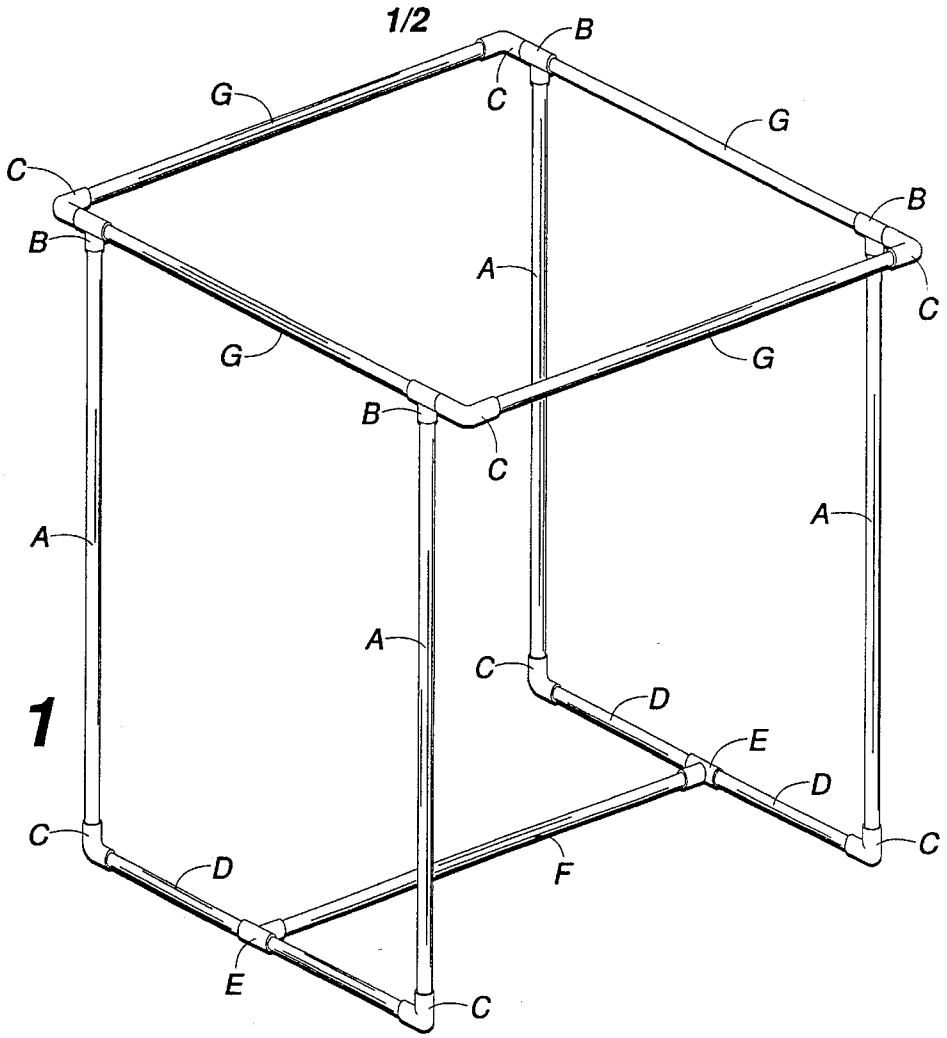
FIG. 1 is a perspective illustration of the canopy structure.

Referring now in more detail to the drawings, in which like numerals indicate like parts throughout the several views, FIG. 1 shows the canopy structure, which includes a centrally positioned longitudinally extending intermediate base support F, which forms the base of the structure for placement beneath the bed (not shown in this figure) and extending from the head to the foot of the bed and intermediate the sides of the bed. Base tee joints E are inserted on each end of the intermediate base support F to form the head and foot of the base structure. Laterally extending tubular base sections D are inserted in the opposite ends of each tee joint E which will accommodate the width of the bed size. Base elbow joints C connect to the distal ends of the tubular base sections D so as to support the vertical tubular sections, or posts A, that will give support and shape to the canopy top. Upper tee joints B are inserted on top of the vertical tubular sections and support laterally extending upper canopy tubes G. Elbows C are interposed between upper tee joints B and the longitudinally extending upper canopy tubes G, so that the longitudinally extending upper canopy tubes G overhang the structure below.

Figure 2:
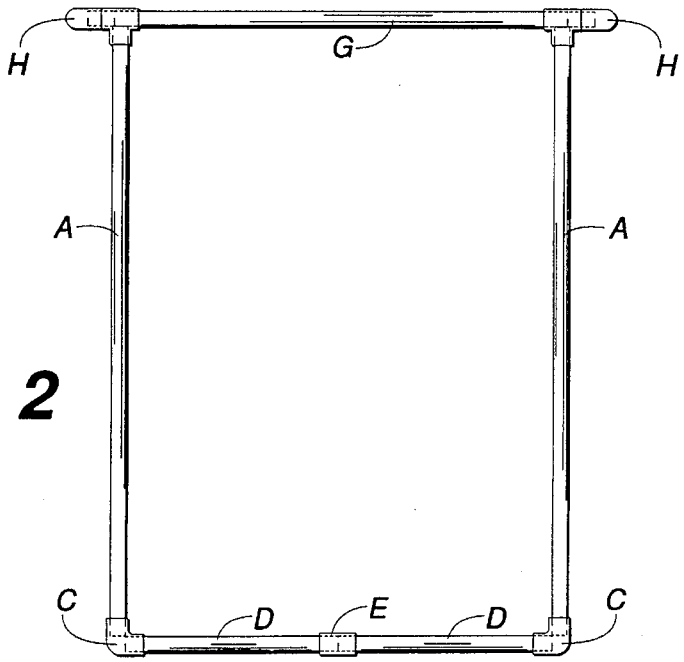
FIG. 2 is an end elevation, showing the end of the structure, which shows the connection for the intermediate support at the base of the structure and the formation of the canopy top.
Figure 3:
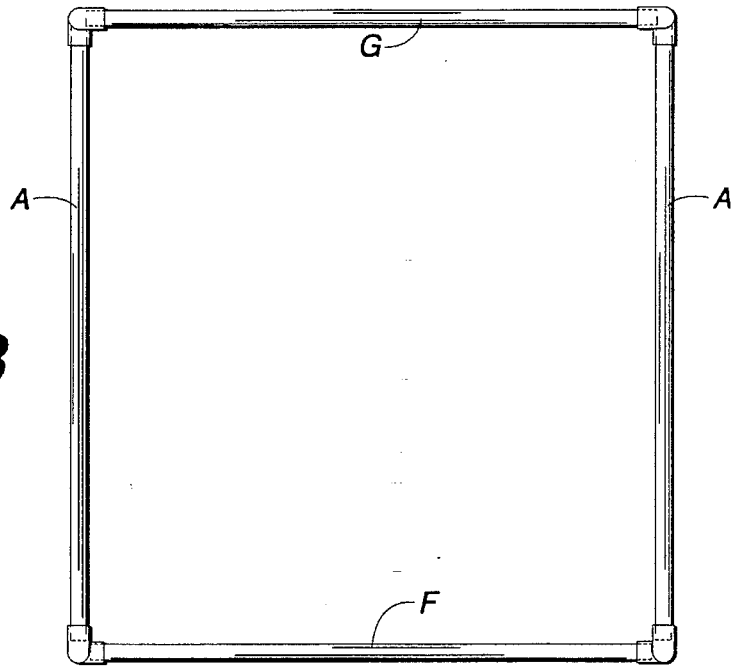
FIG. 3 is a side elevation of the canopy structure, showing the intermediate support, with the rest of the structure extending over the intermediate support.

As illustrated in FIG. 2, a small piece of tubular pipe H is inserted between the upper tee B and the upper elbow C to make these two pieces fit securely together.

With this construction, the base F and the tubular base sections D and their connecting elbows and Tee joints rest on the floor and are not required to be connected to the bed structure that is to be placed in the canopy.

Intermediate base support F ties together the head structure formed by the vertical tubular sections A at the head of the bed and the foot structure formed by the vertical tubular sections A at the foot of the bed to maintain sturdiness and structural form of the canopy structure.

Figure 4:
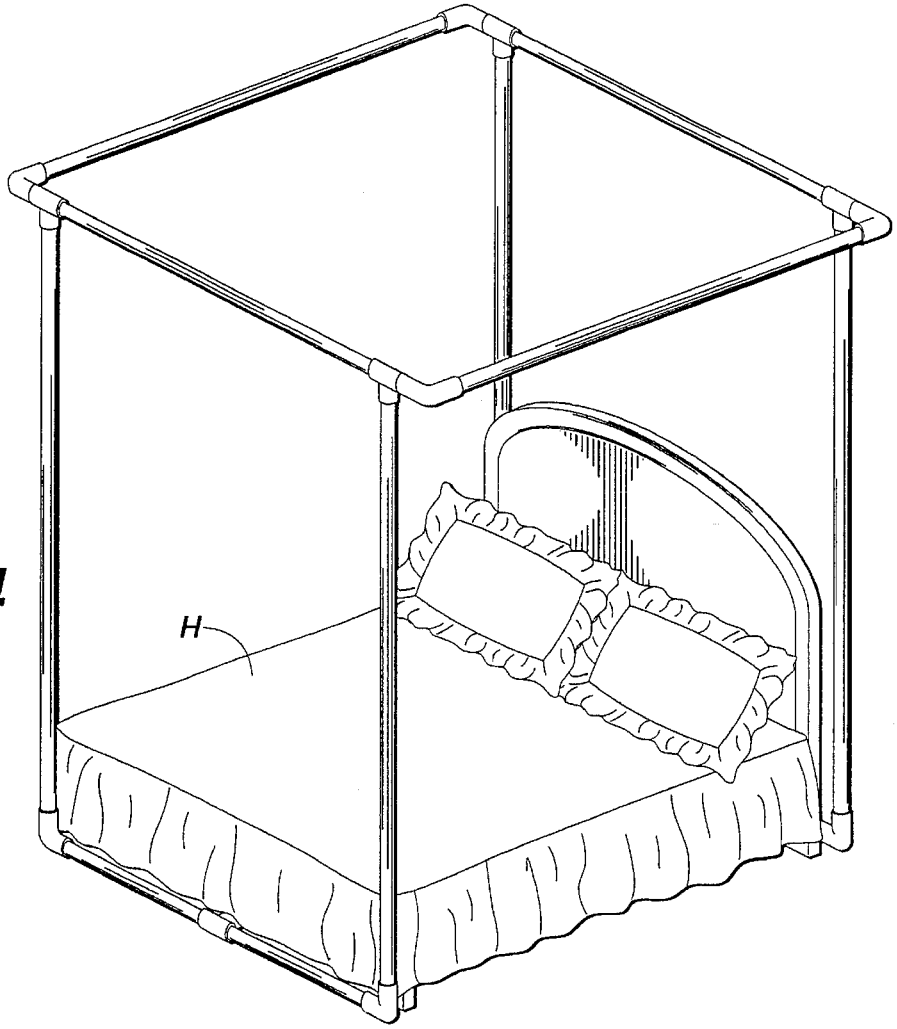
FIG. 4 is a perspective illustration, similar to FIG. 1, but showing the canopy mounted about a bed.

FIG. 4 illustrates the bed H with the canopy structure having been placed about the bed. Typically, the user of the invention will have selected and possibly previously used a bed, and the canopy structure is to be mounted about the bed. The tubular sections and joints are provided, disassembled, in a package to the purchaser. The purchaser assembles the canopy structure about the bed. The joints can be frictionally urged together, or adhesives can be used, if desired. Material can be draped from the tubes G so as to form a fabric screen over and about the bed, with some of the fabrics hiding the tubes, as may be desired.

While the foregoing specification and drawings disclose a preferred embodiment of the invention, it will be understood by those skilled in the art that variations and modifications thereof can be made without departing from the spirit and scope of the invention as set forth in the claims.

I claim:

1. A portable free-standing canopy and bed comprising:

a bed structure resting on a floor;

a free standing base structure placed on the floor independently of and beneath said bed and supporting a canopy above said bed, including a rectilinear longitudinally extending intermediate base support centrally positioned with respect to the bed and resting on the floor, a pair of rectilinear laterally extending base sections each mounted intermediate its ends to an end of said base support, each of said base sections extending laterally from said intermediate base support and resting on the floor, four vertical posts mounted to an end of said laterally extending base sections to form vertical posts extending about said bed, and laterally and longitudinally extending upper canopy tubes connected end to end to one another in a rectangular shape and mounted to upper ends of said vertical posts for supporting canopy material thereon, said laterally extending upper canopy tubes extending laterally beyond said vertical posts, and said longitudinally extending upper canopy tubes being positioned laterally beyond said vertical posts, whereby said canopy is positioned about said bed without requiting support from said bed.

2. A portable free standing canopy and bed as set forth in claim 1, wherein said base support, base sections, vertical posts and laterally and longitudinally extending upper canopy tubes are made from materials selected from the group consisting of: PVC piping, copper, steel, wood, brass and aluminum, and whereby the dimensions of such materials are sufficient to accommodate day bed, twin, full, queen and king sized beds.

* * * * *